United States Patent [19]

Bohash

[11] 3,945,050

[45] Mar. 23, 1976

[54] VISORED CAP

[76] Inventor: James J. Bohash, 20721 Millard St., Taylor, Mich. 48180

[22] Filed: Dec. 24, 1974

[21] Appl. No.: 536,245

[52] U.S. Cl. ..... 2/197

[51] Int. Cl.[2] ..... A42B 1/02

[58] Field of Search ..... 2/171.1, 182.3, 183, 195, 2/196, 197, 209.3, 209.4, 182.6, 171, 198

[56] References Cited

UNITED STATES PATENTS

| | | | |
|---|---|---|---|
| 1,502,679 | 7/1924 | Nutt | 2/183 X |
| 1,512,866 | 10/1924 | Strauss | 2/198 X |
| 1,534,421 | 4/1925 | Smith | 2/197 |
| 1,624,727 | 4/1927 | Goldberg | 2/195 X |
| 2,181,446 | 11/1939 | Ames | 2/209.3 X |
| 2,252,902 | 8/1942 | Subira et al. | 2/183 X |

FOREIGN PATENTS OR APPLICATIONS

| | | | |
|---|---|---|---|
| 258,359 | 9/1926 | United Kingdom | 2/195 |

*Primary Examiner*—G. V. Larkin

[57] ABSTRACT

A visored cap having an adjustable metal strap in its head band. The body portion of the cap comprises spoked pieces connected together at one end and to the head band at the other end. The visor and body portions are each connected to the head band by means of tabs extending through slots therein.

3 Claims, 4 Drawing Figures

VISORED CAP

The invention relates to head covers and, in particular, to caps of the visored type with spoke-like portions comprising the body thereof.

The instant head adornment is provided with a head band which is made adjustable by an overlapping metallic strap in the back portion and attached to the sides of the band. The front of the band is slotted to receive tabs extending from the visor and also connecting tabs extending from the main portion of the cap. The latter consists of spoked pieces radially emanating from the top of the cap and extending to the head band. The central section of the cap provides space for ornaments such as a figure of a horse or race car, the spoked pieces providing a simulated pathway for such figures.

One object of the invention is to provide an improved head cover affording ventilation for the head without sacrificing the protection needed when worn during play of sports as well as during participation in other physical activities.

Other objects and advantages of the invention may be appreciated on reading the following description of one embodiment thereof which is taken in conjunction with the accompanying drawings, in which.

Figure 1:
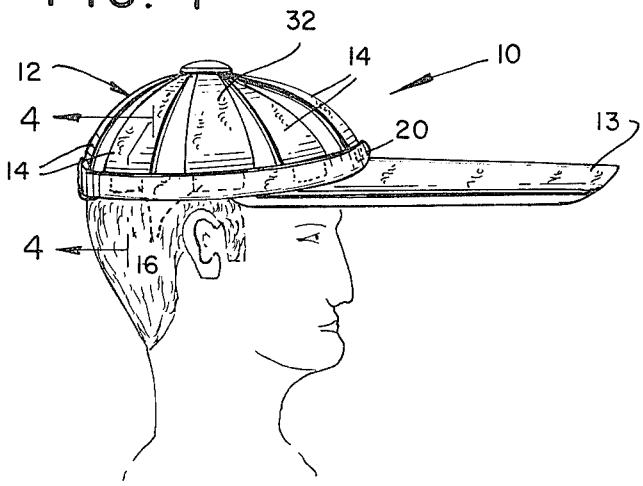
FIG. 1 is a view of the visored cap as worn on the head.
Figure 4:
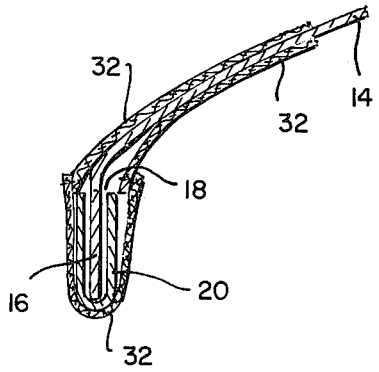
FIG. 4 is an enlarged section taken on line 4—4 of FIG. 1.
Figure 2:
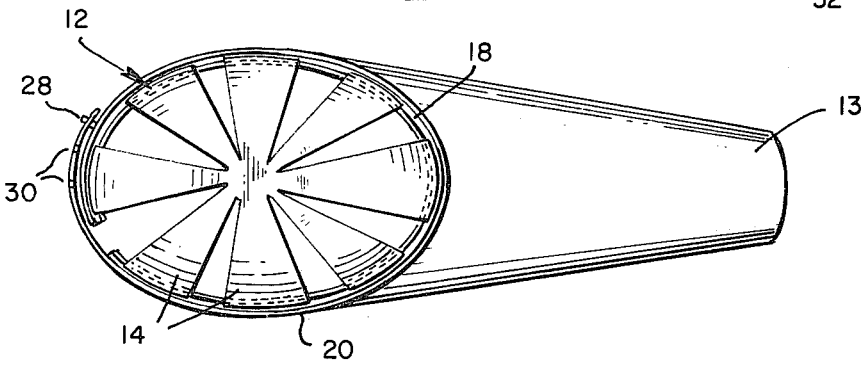
FIG. 2 is a plan view of the cap.
Figure 3:
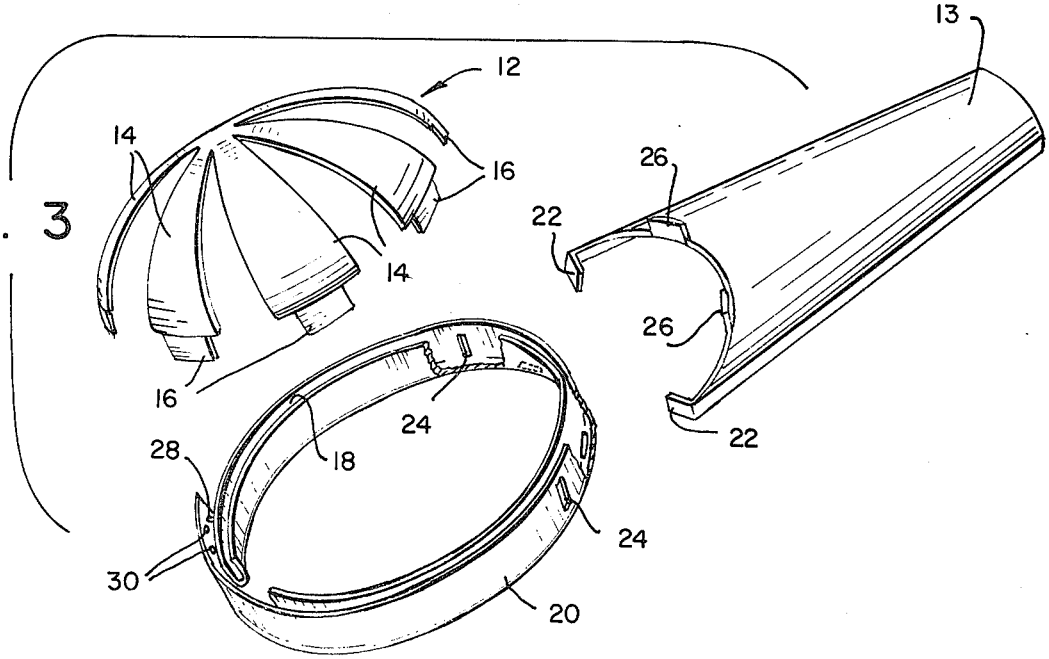
FIG. 3 is an exploded view in perspective showing separately the principal components of the cap.

Referring to the drawings cap 10 has a body portion 12 and a visor portion 13. The body portion comprises spaced apart and radially directed spoked pieces 14 which are connected at the top and have tabs 16 at their bottom ends. The tabs are received and slidably held in an annular slot 18 in head band 20 which is a U-shaped member encircling the cap with overlapping ends in the back thereof.

The spoked elements may be fabricated of a flexible or spring material such as a light weight metal, alloyed or anodized, a plastic or rubber. It is apparent that if a ball or puck should impact against this portion of the cap the elements will flex slightly and can slide toward and away from each other in slot 18 and thus absorb some of the shock and to that extent afford protection to the head. In addition, the sliding connection between the elements and the band provides further flexibility and yield thus affording further protection to the head.

The sun visor 13 is held in place by inwardly directed tabs 22 inserted in vertical, side wall slots 24 in the head band 20 and upwardly directed tabs 26 received by the annular slot 18 of the head band through horizontal, side wall slots in the head band.

The head band is adjustable to accommodate different head sizes by virtue of its overlapping ends in the back of the cap with a hook 28 extending from one end of the band adapted to be inserted in one of the slots 30 provided in the outer side wall of the other end thereof.

The entire cap is covered preferably by a felt cloth 32 to hold the assembly of the visor and body portion of the cap to the head band.

Various modifications of the invention may be effected by persons skilled in the art without departing from the scope and principle thereof as defined in the appended claims.

What is claimed is:

1. A head covering comprising a body portion consisting of a plurality of spaced, spoked members, a head band encircling said body portion, said spoked members being fabricated of a flexible material, said head band being double walled defining an annular slot, tabs being provided at the ends of said members and received in said slot to afford a horizontally slidable connection therein with said band.

2. A head covering as defined in claim 1 wherein said head band is adjustable in size, the ends of the band being overlapped, one end having a hook element and the side wall of the other end having slots to receive said element.

3. A head covering as defined in claim 1 wherein there is provided a visor having tabs connected to said band inserted in said annular slot and in side wall slots formed therein.

* * * * *